US011067945B2

(12) United States Patent
Yamamoto

(10) Patent No.: US 11,067,945 B2
(45) Date of Patent: Jul. 20, 2021

(54) IMAGE FORMING APPARATUS INCLUDING SHEET FEEDING CASSETTE AND CONVEYANCE UNIT ATTACHABLE AND DETACHABLE TO AND FROM APPARATUS MAIN BODY

(71) Applicant: KYOCERA Document Solutions Inc., Osaka (JP)

(72) Inventor: Kiyonori Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/834,118

(22) Filed: Mar. 30, 2020

(65) Prior Publication Data

US 2020/0331718 A1 Oct. 22, 2020

(30) Foreign Application Priority Data

Apr. 19, 2019 (JP) ..... JP2019-080223

(51) Int. Cl.
*G03G 15/00* (2006.01)
*G03G 21/00* (2006.01)
*G03G 21/16* (2006.01)

(52) U.S. Cl.
CPC ..... *G03G 21/1695* (2013.01)

(58) Field of Classification Search
CPC ..... G03G 21/16; G03G 21/1695; G03G 21/1623; G03G 21/1638
USPC ..... 399/110, 124
See application file for complete search history.

(56) References Cited

U.S. PATENT DOCUMENTS

| | | | | |
|---|---|---|---|---|
| 8,185,016 | B2 * | 5/2012 | Mori et al. | G03G 21/1623 399/124 |
| 9,176,462 | B2 * | 11/2015 | Ohta et al. | G03G 21/1638 |
| 9,663,311 | B2 * | 5/2017 | Tanio | G03G 21/1695 |
| 10,289,059 | B2 * | 5/2019 | Soda et al. | G03G 21/1623 |
| 10,466,639 | B2 * | 11/2019 | Kanno | G03G 21/1638 |
| 2010/0166455 | A1 | 7/2010 | Mori et al. | |
| 2017/0052506 | A1 | 2/2017 | Kataoka | |

FOREIGN PATENT DOCUMENTS

JP 2008127181 A 6/2008

OTHER PUBLICATIONS

The extended European search report issued by the European Patent Office dated Sep. 22, 2020, which corresponds to European Patent Application No. 20161088.8-1010 and is related to U.S. Appl. No. 16/834,118.

* cited by examiner

*Primary Examiner* — William J Royer
(74) *Attorney, Agent, or Firm* — Studebaker & Brackett PC

(57) ABSTRACT

An image forming apparatus includes an apparatus main body, a first sheet feeding cassette, a conveyance unit and a lock member. The first sheet feeding cassette is inserted into the apparatus main body along a predetermined insertion direction and is drawn out of the apparatus main body along a drawing direction opposite to the insertion direction. In a state where the lock member is in a lock position, the first sheet feeding cassette does not interfere with the lock member to allow the first sheet feeding cassette to be inserted into the apparatus main body. In a state where the lock member is in a lock release position, the first sheet feeding cassette interferes with the lock member to inhibit the first sheet feeding cassette from being inserted into the apparatus main body.

9 Claims, 12 Drawing Sheets

IMAGE FORMING APPARATUS INCLUDING SHEET FEEDING CASSETTE AND CONVEYANCE UNIT ATTACHABLE AND DETACHABLE TO AND FROM APPARATUS MAIN BODY

INCORPORATION BY REFERENCE

This application is based on and claims the benefit of priority from Japanese patent application No. 2019-080223 filed on Apr. 19, 2019, which is incorporated by reference in its entirety.

BACKGROUND

The present disclosure relates to an image forming apparatus.

An image forming apparatus conventionally includes an apparatus main body in which a sheet conveyance path is formed, a sheet feeding cassette in which sheets are stored and a conveyance unit which conveys a sheet from the sheet feeding cassette to the sheet conveyance path. In some cases, the above conveyance unit is provided so as to be drawable out of the apparatus main body of the image forming apparatus in view of easiness of a jam treatment operation (operation to remove a jammed sheet).

In the above image forming apparatus, when a sheet conveying operation is performed under a state where the conveyance unit is not locked to the apparatus main body (a state where the drawing the conveyance unit out of the apparatus main body is allowed), the conveyance unit may be displaced with respect to the apparatus main body. When the conveyance unit may be displaced with respect to the apparatus main body, a conveyance position of the sheet by the conveyance unit may be also displaced, which may cause sheet jamming or sheet skew.

SUMMARY

In accordance with an aspect of the present disclosure, an image forming apparatus includes an apparatus main body, a first sheet feeding cassette, a conveyance unit and a lock member. In the apparatus main body, a sheet conveyance path is formed. The first sheet feeding cassette is inserted into the apparatus main body along a predetermined insertion direction and is drawn out of the apparatus main body along a drawing direction opposite to the insertion direction. The first sheet feeding cassette stores a sheet. The conveyance unit is drawn out of the apparatus main body along the drawing direction after the first sheet feeding cassette is drawn out, and is inserted into the apparatus main body along the insertion direction before the first sheet feeding cassette is inserted. The conveyance unit feeds the sheet and then conveys the sheet to the sheet conveyance path. The lock member is displaced between a lock position where the lock member inhibits the conveyance unit from being drawn out of the apparatus main body and a lock release position where the lock member allows the conveyance unit to be drawn out of the apparatus main body. In a state where the lock member is in the lock position, the first sheet feeding cassette does not interfere with the lock member to allow the first sheet feeding cassette to be inserted into the apparatus main body. In a state where the lock member is in the lock release position, the first sheet feeding cassette interferes with the lock member to inhibit the first sheet feeding cassette from being inserted into the apparatus main body.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
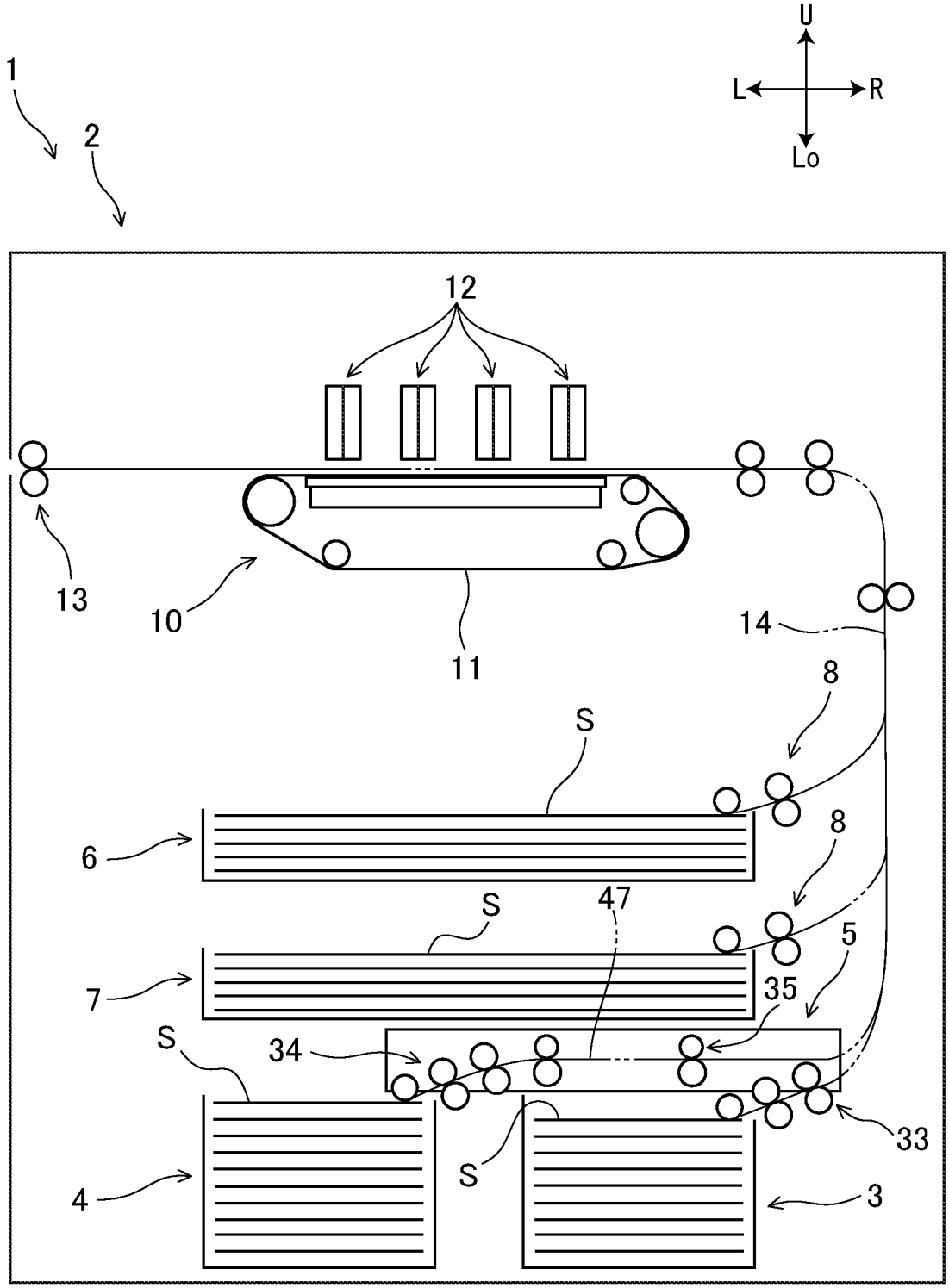
FIG. 1 is a front view schematically showing an image forming apparatus according to one embodiment of the present disclosure.

Hereinafter, an image forming apparatus 1 according to one embodiment of the present disclosure will be described with reference to the drawings. In the following description, for convenience of explanation, a near side (a front side) of a paper surface of FIG. 1 is defined to be a front side of the image forming apparatus 1. Arrows L, R, U, Lo, Fr and Rr marked in each figure respectively show a left side, a right side, an upper side, a lower side, a front side and a rear side of the image forming apparatus 1.

Firstly, an entire structure of the image forming apparatus 1 will be described.

With reference to FIG. 1, the image forming apparatus 1 is an inkjet type color printer, for example. The image forming apparatus 1 includes a box-like shaped apparatus main body 2.

In the lower end portion of the apparatus main body 2, a first sheet feeding cassette 3 and a second sheet feeding cassette 4 are disposed side by side in the left-and-right direction. Each of the first sheet feeding cassette 3 and the second sheet feeding cassette 4 stores sheets S. In the lower portion of the apparatus main body 2, a conveyance unit 5 is provided above the first sheet feeding cassette 3 and the second sheet feeding cassette 4.

In the lower portion of the apparatus main body 2, a third sheet feeding cassette 6 and a fourth sheet feeding cassette 7 are disposed in the upper-and-lower direction above the conveyance unit 5. Each of the third sheet feeding cassette 6 and the fourth sheet feeding cassette 7 stores the sheets S. In the lower portion of the apparatus main body 2, a sheet feeding unit 8 is provided on a right side of each of the third sheet feeding cassette 6 and the fourth sheet feeding cassette 7.

In the upper portion of the apparatus main body 2, an image forming part 10 is provided. The image forming part 10 includes a conveyance belt 11 and four recording heads 12. The four recording heads 12 are provided so as to be injectable inks of black, cyan, magenta and yellow. In the upper portion of the apparatus main body 2, a discharge unit 13 is provided on a left side of the image forming part 10.

Inside the apparatus main body 2, a sheet conveyance path 14 is provided. The upstream end portion of the sheet conveyance path 14 is connected to the conveyance unit 5 and the sheet feeding units 8. The midstream portion of the sheet conveyance path 14 passes through the image forming part 10. The downstream end portion of the sheet conveyance path 14 is connected to the discharge unit 13.

Next, operation of the image forming apparatus 1 will be described.

First, the sheet S is fed from the first sheet feeding cassette 3 or the second sheet feeding cassette 4 by the conveyance unit 5, or from the third sheet feeding cassette 6 or the fourth sheet feeding cassette 7 by the corresponding sheet feeding unit 8. The sheet S fed from either of the sheet feeding cassettes 3, 4, 6 and 7 is conveyed downstream along the sheet conveyance path 14, enters the image forming part 10, and then is sucked to the upper face of the conveyance belt 11. The recording heads 12 inject the inks on the sheet S sucked on the upper face of the conveyance belt 11. Then, an image is formed on the sheet S. The sheet S on which the image is formed is further conveyed downstream along the sheet conveyance path 14, and then discharged by the discharge unit 13 outside the apparatus main body 2.

Next, the first sheet feeding cassette 3 will be described.

Figure 2:
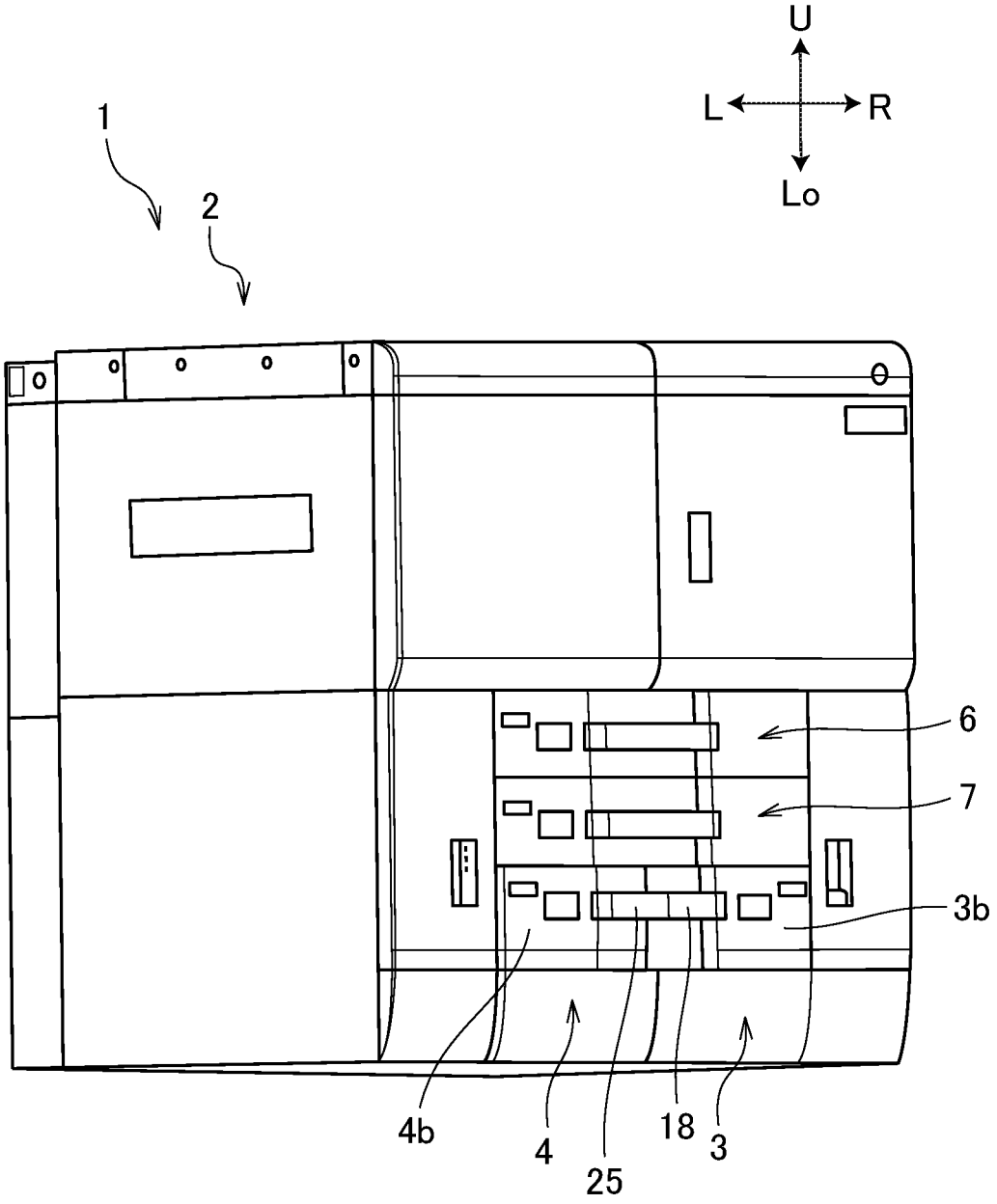
FIG. 2 is a perspective view showing the image forming apparatus according to the embodiment of the present disclosure.
Figure 3:
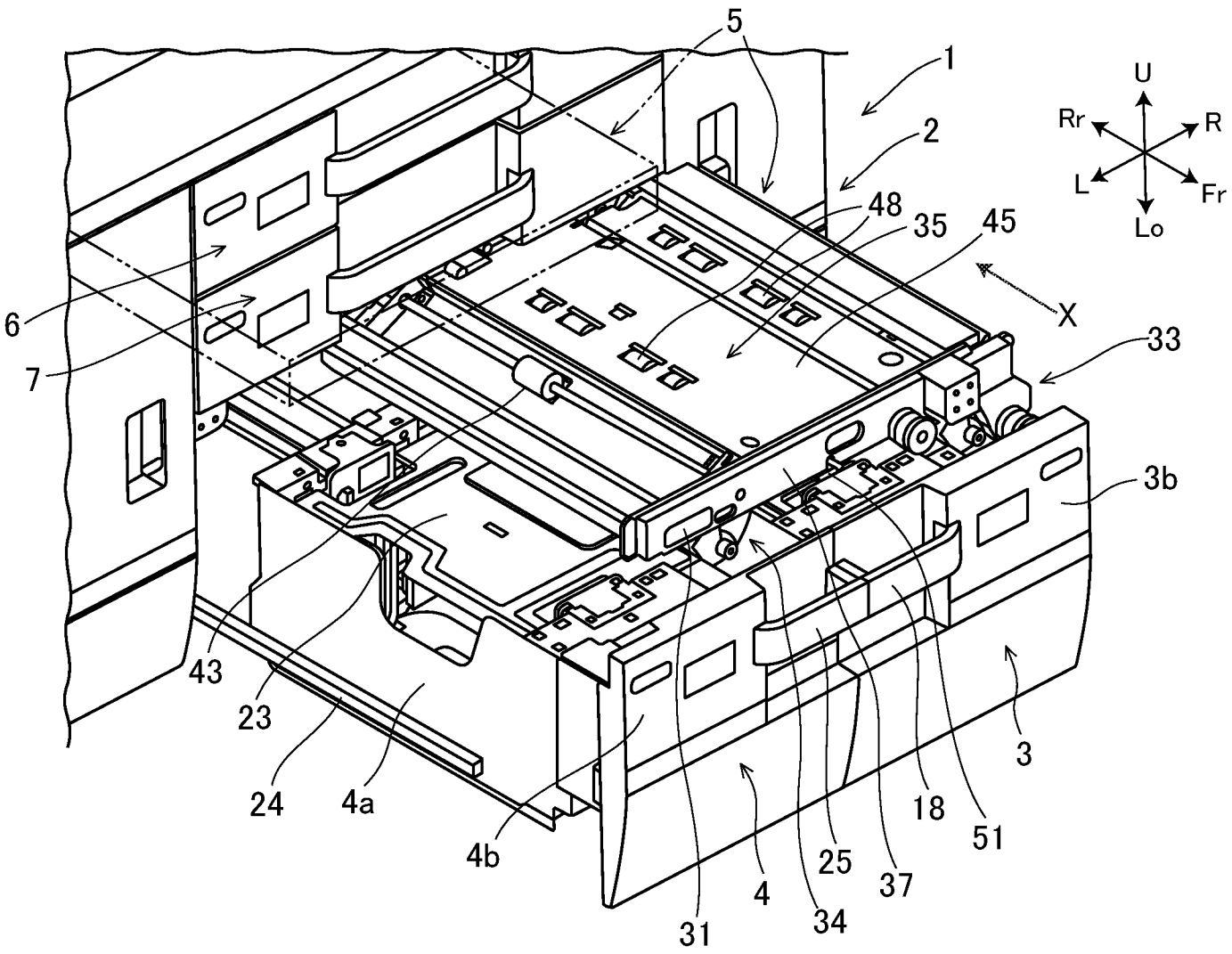
FIG. 3 is a perspective view showing a first and a second sheet feeding cassettes and a conveyance unit which are drawn out of an apparatus main body, in the image forming apparatus according to the embodiment of the present disclosure.
Figure 4:
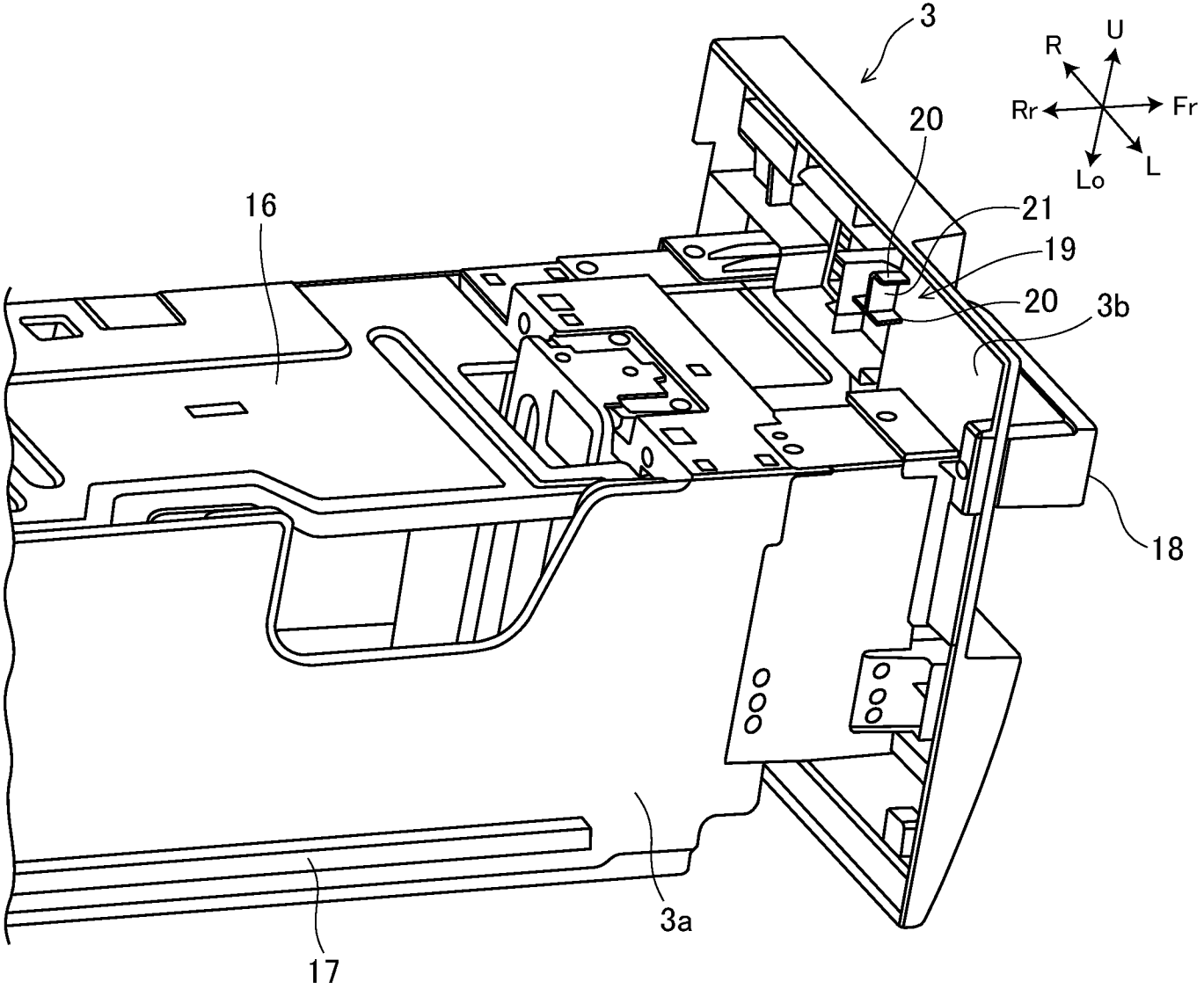
FIG. 4 is a perspective view showing the first sheet feeding cassette, in the image forming apparatus according to the embodiment of the present disclosure.

With reference to FIG. 2 to FIG. 4, the first sheet feeding cassette 3 is formed into a box-like shape whose upper face is opened. Inside the first sheet feeding cassette 3, an elevatable first lift plate 16 is stored. On the first lift plate 16, the sheets S (not shown in FIG. 2 to FIG. 4) are placed.

On each lower portion of a left side wall 3*a* and a right side wall (not shown) of the first sheet feeding cassette 3, a first engagement protrusion 17 extending along the front-and-rear direction is formed. The first engagement protrusion 17 is engaged with a first guide rail (not shown) of the apparatus main body 2. Then, the first sheet feeding cassette 3 is movable along the front-and-rear direction between a position where it is inserted into the apparatus main body 2 (refer to FIG. 2) and a position where it is drawn out of the apparatus main body 2 (refer to FIG. 3). That is, the first sheet feeding cassette 3 is drawably inserted into the apparatus main body 2, and inserted into the apparatus main body 2 along an insertion direction from the rear side to the front side and drawn out of the apparatus main body 2 along a drawing direction opposite to the insertion direction.

On the left upper portion of the front face (the outer face) of a front wall 3*b* of the first sheet feeding cassette 3, a first grip 18 is provided. On the upper center portion of the rear face (the inner face) of the front wall 3*b* of the first sheet feeding cassette 3, a first rib 19 is protruded. The first rib 9 has a pair of upper and lower extension plates 20 extending in the left-and-right direction and a coupling plate 21 extending in the upper-and-lower direction and coupling the upper and lower extension plates 20.

Next, the second sheet feeding cassette 4 will be described.

Figure 5:
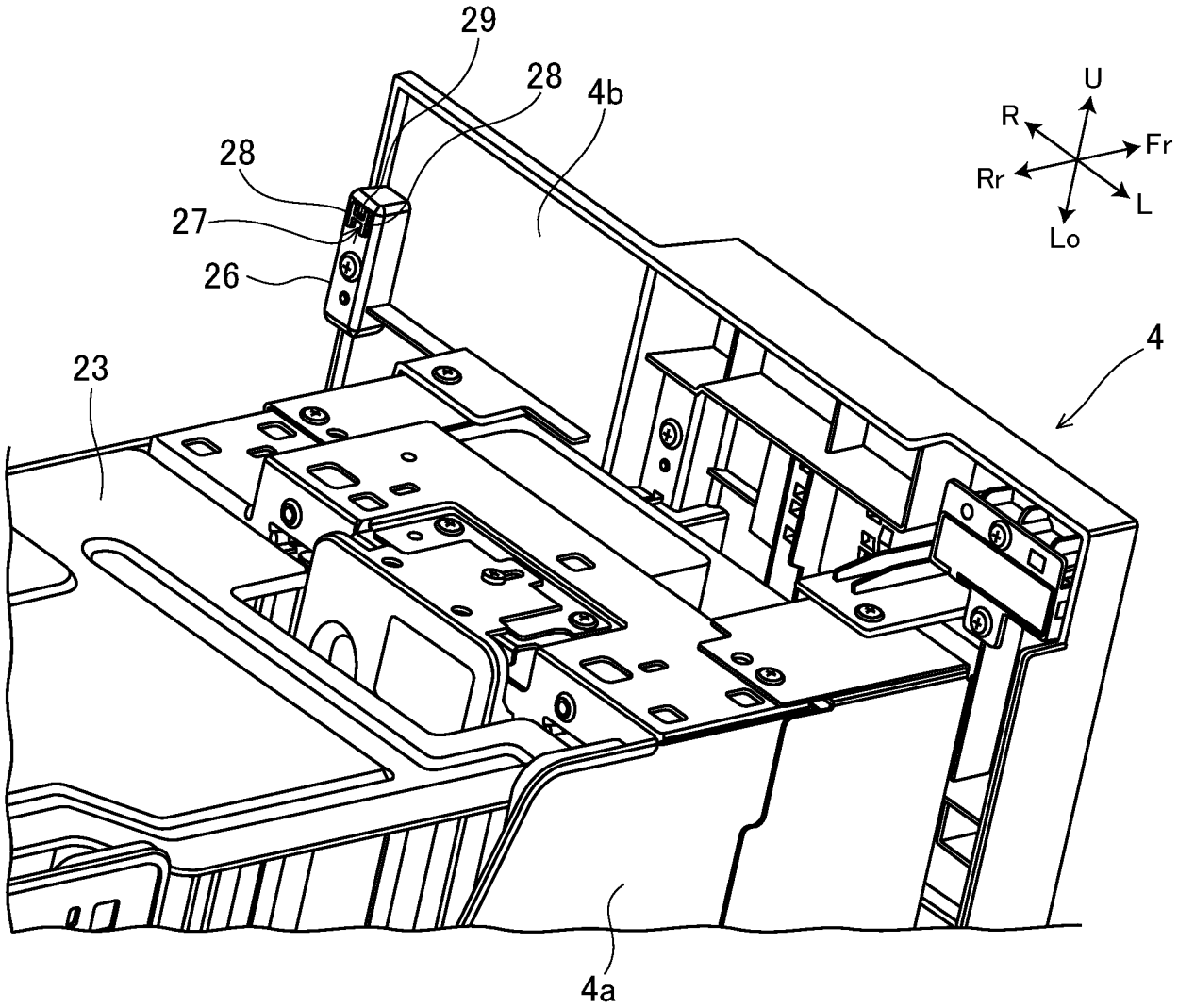
FIG. 5 is a perspective view showing the second sheet feeding cassette, in the image forming apparatus according to the embodiment of the present disclosure.

With reference to FIG. 2, FIG. 3 and FIG. 5, the second sheet feeding cassette 4 is disposed adjacent to the first sheet feeding cassette 3 on a left side (one side in the left-and-right direction) of the first sheet feeding cassette 3. The second sheet feeding cassette 4 is formed into a box-like shape whose upper face is opened. Inside the second sheet feeding cassette 4, an elevatable second lift plate 23 is stored. On the second lift plate 23, the sheets S (not shown in FIG. 2, FIG. 3 and FIG. 5) are placed.

On each lower portion of a left side wall 4*a* and a right side wall (not shown) of the second sheet feeding cassette 4, a second engagement protrusion 24 extending along the front-and-rear direction is formed. The second engagement protrusion 24 is engaged with a second guide rail (not shown) of the apparatus main body 2. Then, the second sheet feeding cassette 4 is movable along the front-and-rear direction between a position where it is inserted into the apparatus main body 2 (refer to FIG. 2) and a position where it is drawn out of the apparatus main body 2 (refer to FIG. 3). That is, the second sheet feeding cassette 4 is drawably inserted into the apparatus main body 2, and inserted into the apparatus main body 2 in an insertion direction parallel to the insertion direction of the first sheet feeding cassette 3 and drawn out of the apparatus main body 2 in a drawing direction opposite to the insertion direction.

On the left upper portion of the front face (the outer face) of a front wall 4*b* of the second sheet feeding cassette 4, a second grip 25 is provided. On the right upper portion of the rear face (the inner face) of the front wall 4*b* of the second sheet feeding cassette 4, a pedestal 26 is protruded. On the upper portion of the rear face (the inner face) of the pedestal 26, a second rib 27 is protruded. The second rib 27 has a pair of left and right extension plates 28 extending in the upper-and-lower direction and a coupling plate 29 extending in the left-and-right direction and coupling the left and right extension plates 28.

Next, the conveyance unit 5 will be described.

With reference to FIG. 3, the conveyance unit 5 is formed into a shallow parallelepiped shape long in the left-and-right direction and in the front-and-rear direction. The conveyance unit 5 has an engagement protrusion (not shown) extending along the front-and-rear direction. The engagement protrusion is engaged with a guide rail (not shown) of the apparatus main body 2. Then, the conveyance unit 5 is movable along the front-and-rear direction between a position where it is inserted into the apparatus main body 2 (refer to the two-dotted chain line in FIG. 3) and a position where it is drawn out of the apparatus main body 2 (refer to the solid line in FIG. 3). That is, the conveyance unit 5 is drawably inserted into the apparatus main body 2. The conveyance unit 5 is inserted into the apparatus main body 2 in an insertion direction parallel to the insertion directions of the first and second sheet feeding cassettes 3 and 4 and is drawn out of the apparatus main body 2 in a drawing direction opposite to the insertion direction.

Arrows X marked in the figures show the insertion direction of the conveyance unit 5 to the apparatus main body 2 (hereinafter, called "the insertion direction X"). The insertion direction X is a direction from the front side to the rear side along the front-and-rear direction, and perpendicular to the upper-and-lower direction and the left-and-right direction. The insertion direction X is the same direction as the insertion directions of the first and second sheet feeding cassettes 3 and 4. Hereinafter, "an upstream side in the insertion direction" and "a downstream side in the insertion direction" show "an upstream side" and "a downstream side" in the insertion direction X.

Figure 6:
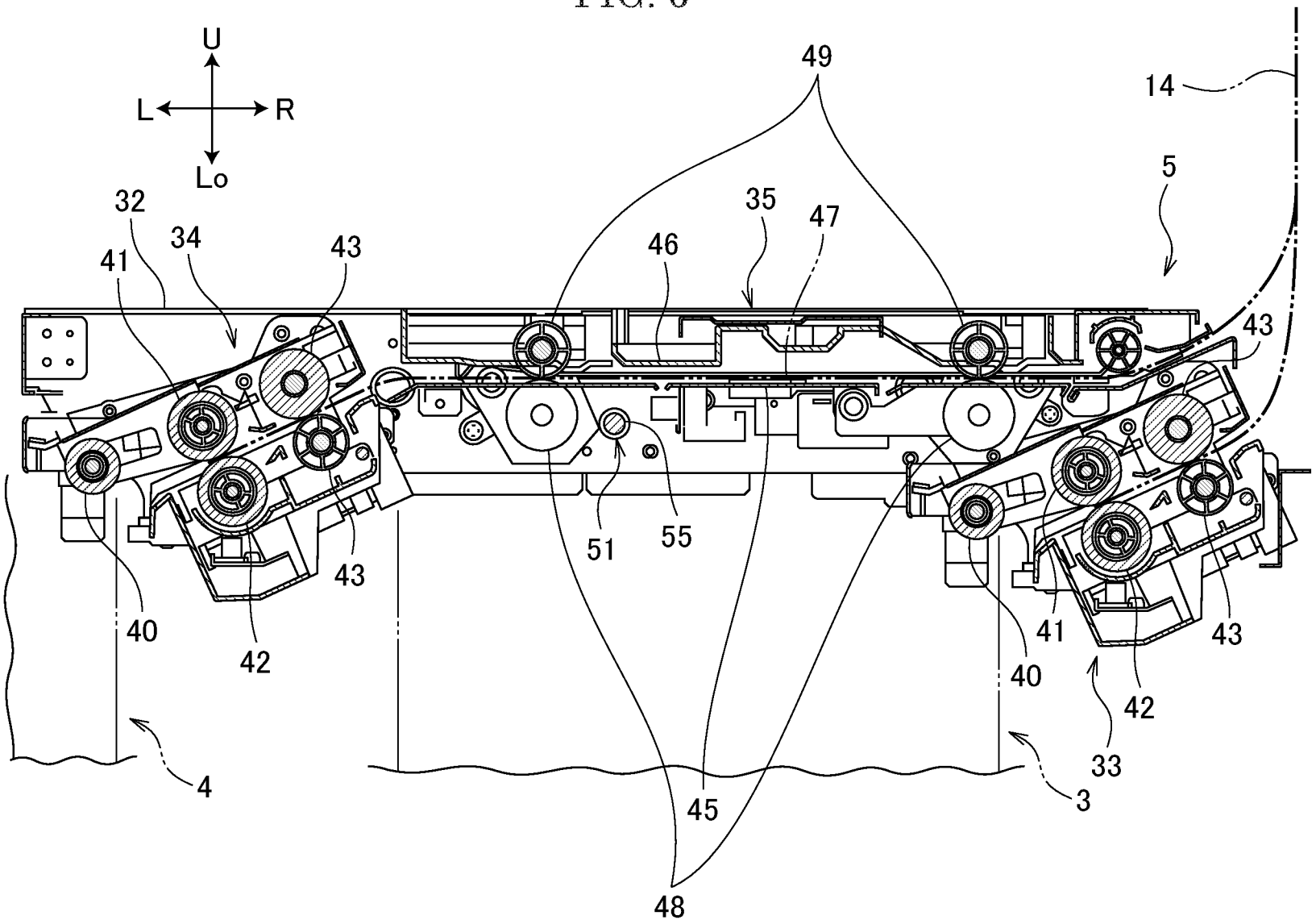
FIG. 6 is a sectional view showing the conveyance unit and a lock member, in the image forming apparatus according to the embodiment of the present disclosure.
Figure 7:
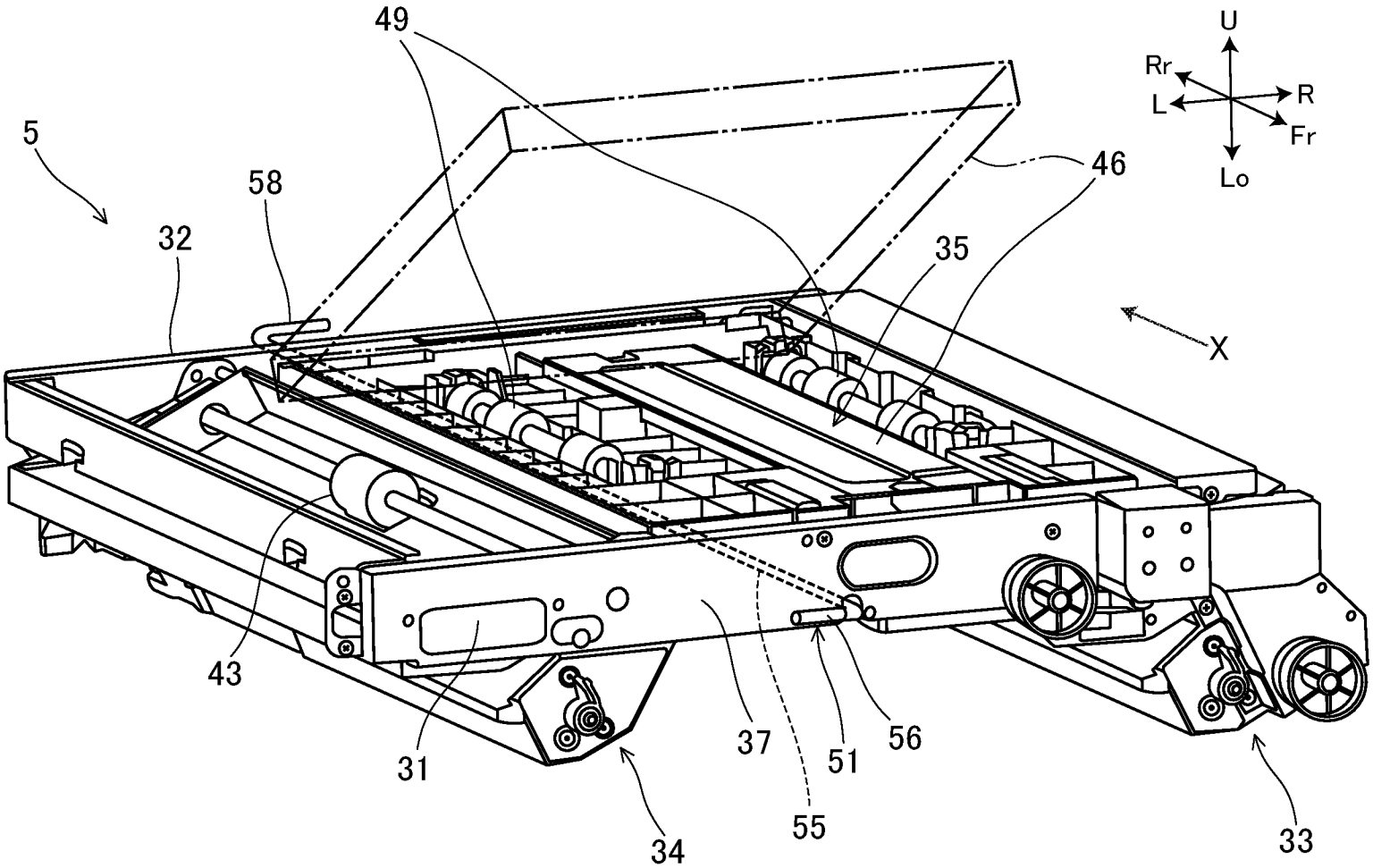
FIG. 7 is a perspective view showing the conveyance unit and the lock member, in the image forming apparatus according to the embodiment of the present disclosure.

With reference to FIG. 6 and FIG. 7, the conveyance unit 5 includes a pair of front and rear frames 31 and 32, a first and a second sheet feeding mechanisms 33 and 34 and a horizontal conveyance mechanism 35 which are disposed between the front and rear frames 31 and 32.

Figure 8:
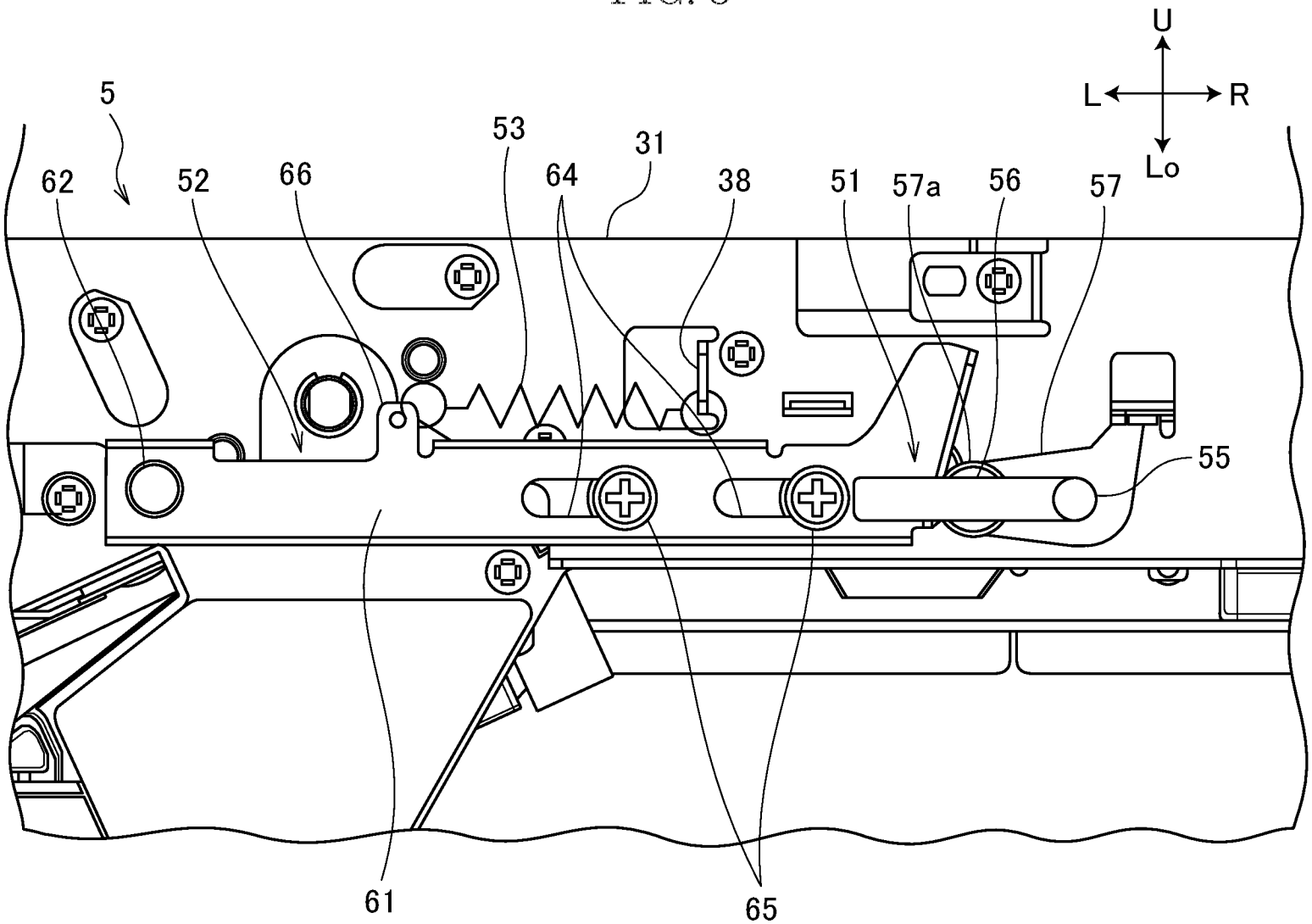
FIG. 8 is a front view showing the lock member in a lock position and a stopper in an allowable position, in the image forming apparatus according to the embodiment of the present disclosure.
Figure 9:
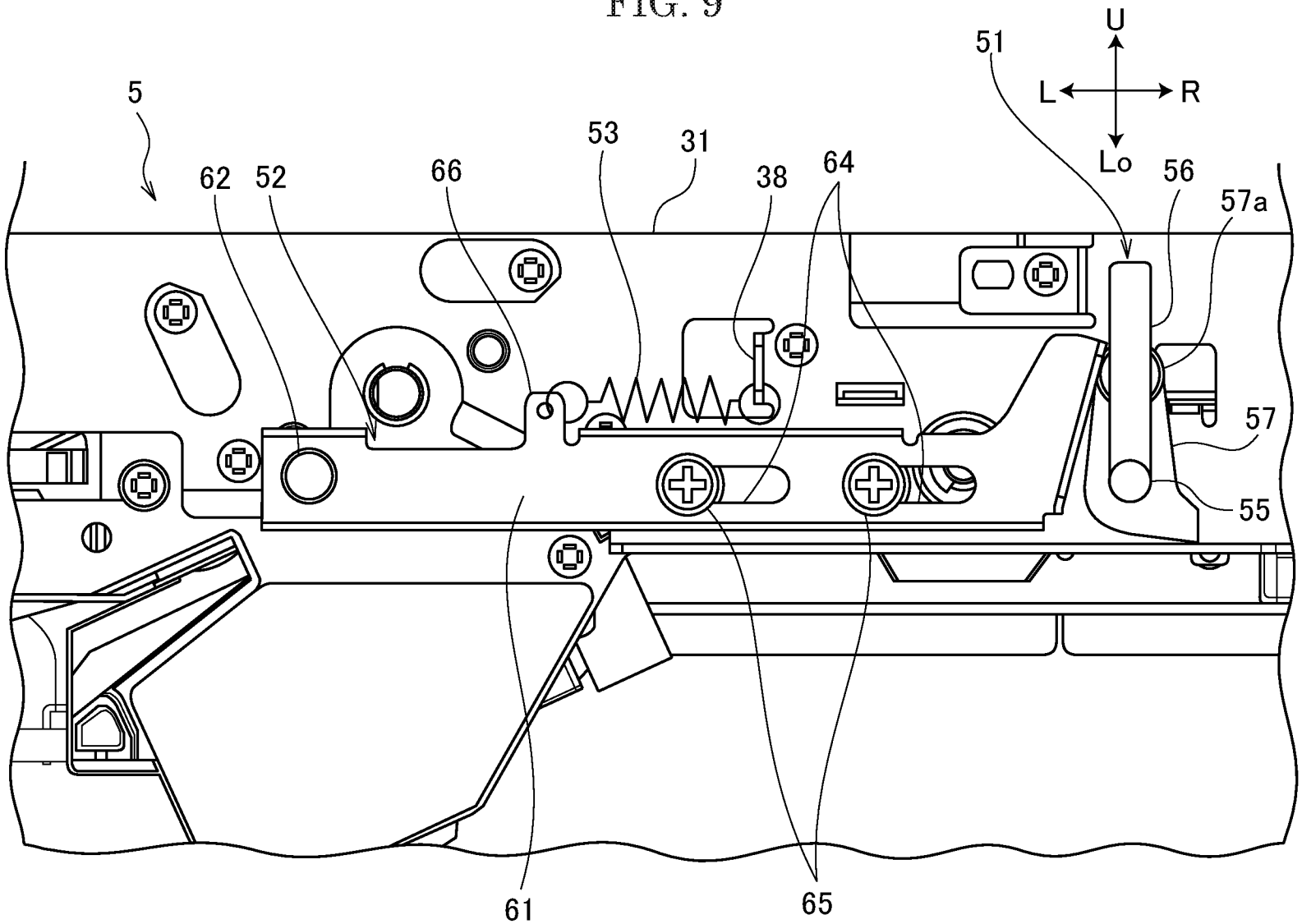
FIG. 9 is a front view showing the lock member in a lock release position and the stopper in a inhibition position, in the image forming apparatus according to the embodiment of the present disclosure.
Figure 10:
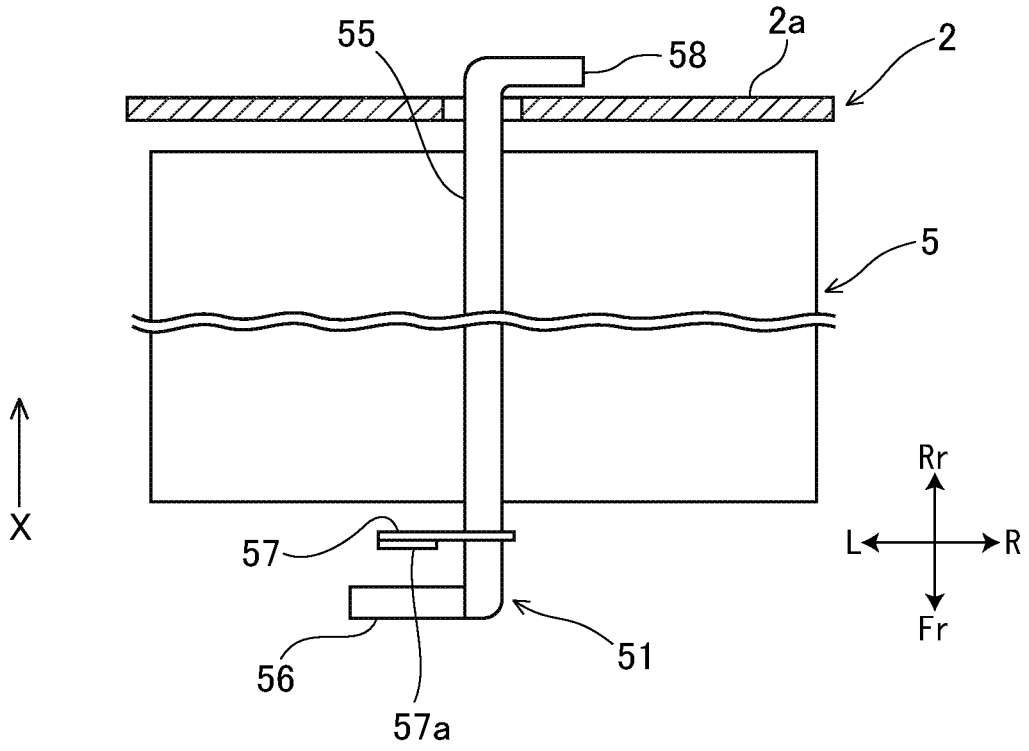
FIG. 10 is a plan view showing the lock member in the lock position, in the image forming apparatus according to the embodiment of the present disclosure.
Figure 11:
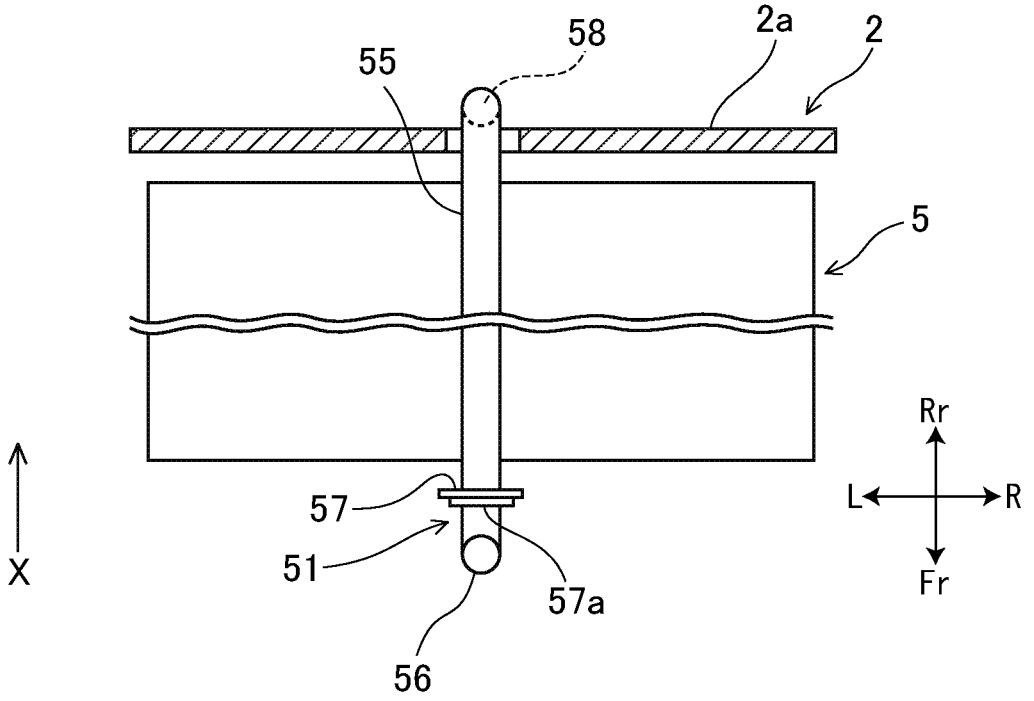
FIG. 11 is a plan view showing the lock member in the lock release position, in the image forming apparatus according to the embodiment of the present disclosure.

The front and rear frames 31 and 32 of the conveyance unit 5 extend along the left-and-right direction. The front frame 31 is covered with a frame cover 37 from the front side (the upstream side in the insertion direction). The frame cover 37 is not shown in FIG. 8 and FIG. 9. With reference to FIG. 8 and FIG. 9, on the center portion in the left-and-right direction of the front face (the outer face) of the front frame 31, a frame side attachment part 38 is protruded forward.

With reference to FIG. 6, the first sheet feeding mechanism 33 of the conveyance unit 5 is disposed on a right upper side of the first sheet feeding cassette 3. The first sheet feeding mechanism 33 includes a pickup roller 40, a feed roller 41 and a retard roller 42 which are disposed on a right side of the pickup roller 40 and a pair of upper and lower auxiliary conveyance rollers 43 disposed on a right side of the feed roller 41 and the retard roller 42. The feed roller 41 and the retard roller 42 come in contact with each other. The retard roller 42 includes a torque limiter (not shown). The upper and lower auxiliary conveyance rollers 43 come into contact with each other.

The second sheet feeding mechanism 34 of the conveyance unit 5 is disposed on a right upper side of the second sheet feeding cassette 4. The second sheet feeding mechanism 34 has the same configuration as the first sheet feeding mechanism 33, and its explanation is omitted.

With reference to FIG. 6 and FIG. 7, the horizontal conveyance mechanism 35 of the conveyance unit 5 includes a lower conveyance guide 45 and an upper conveyance guide 46 disposed above the lower conveyance guide 45. Between the lower conveyance guide 45 and the upper conveyance guide 46, a horizontal conveyance path 47 is formed. The upper conveyance guide 46 is not shown in FIG. 3.

With reference to FIG. 6, the lower conveyance guide 45 of the horizontal conveyance mechanism 35 extends along the left-and-right direction. The lower conveyance guide 45 is provided with a pair of left and right lower conveyance rollers 48.

With reference to FIG. 6 and FIG. 7, the upper conveyance guide 46 of the horizontal conveyance mechanism 35 extends along the left-and-right direction. The upper conveyance guide 46 is turnable with respect to the lower conveyance guide 45 between an open position where the horizontal conveyance path 47 is opened (refer to the two-dotted chain line in FIG. 7) and a close position where the horizontal conveyance path 47 is closed (refer to the solid line in FIG. 7). The upper conveyance guide 46 is provided with a pair of left and right upper conveyance rollers 49. The upper conveyance rollers 49 come into contact with the lower conveyance rollers 48 of the lower conveyance guide 45 in a state where the upper conveyance guide 46 is in the close position (refer to the solid line in FIG. 7).

With reference to FIG. 7 to FIG. 9, the conveyance unit 5 configured in the above described manner is provided with a lock member 51, a stopper 52 and a coil spring 53 (an example of a biasing member). Hereinafter, these members are described in the order.

First, the lock member 51 will be described.

With reference to FIG. 7 to FIG. 11, the lock member 51 is inhibited from being moved in the front-and-rear direction with respect to the conveyance unit 5, and the lock member 51 is thus movable together with the conveyance unit 5 in the front-and-rear direction.

The lock member 51 has a shaft part 55, a lever part 56, a pushing part 57 and an engagement part 58. The shaft part 55 extends linearly along the insertion direction X. The lever part 56 extends from the front end portion (the upstream side end portion in the insertion direction X) of the shaft part 55 in a radial direction of the shaft part 55. The pushing part 57 extends from the front portion of the shaft part 55 in a radial direction of the shaft part 55. The engagement part 58 extends from the rear end portion (the downstream side end portion in the insertion direction X) of the shaft part 55 in a radial direction of the shaft part 55. The pushing part 57 is not shown in FIG. 7.

The shaft part 55 of the lock member 51 is rotatably attached to the pair of front and rear frames 31 and 32 of the conveyance unit 5. Then, the lock member 51 is rotatable around the shaft part 55 between a lock position (refer to FIG. 8 and FIG. 10) and a lock release position (refer to FIG. 9 and FIG. 11).

The lever part 56 of the lock member 51 is disposed on a front side (the upstream side in the insertion direction X) of the front frame 31 of the conveyance unit 5. The lever part 56 is provided separately from the shaft part 55, and fixed to the shaft part 55.

The pushing part 57 of the lock member 51 is disposed on a front side (an upstream side in the insertion direction X) of the front frame 31 of the conveyance unit 5. The pushing part 57 is provided separately from the shaft part 55, and fixed to the shaft part 55. The pushing part 57 is provided on a rear side (a downstream side in the insertion direction X) of the lever part 56 via an interval. The pushing part 57 is protruded in the same side as the lever part 56 with respect to the shaft part 55. A tip end portion 57*a* (the end portion on a side separate from the shaft part 55) of the pushing part 57 is curved in an arc shape.

The engagement part 58 of the lock member 51 is disposed on a rear side (a downstream side in the insertion direction X) of the rear frame 32 of the conveyance unit 5. The engagement part 58 is formed integrally with the shaft part 55. The engagement part 58 is protruded on an opposite side to the lever part 56 with respect to the shaft part 55.

Next, the stopper 52 will be described.

With reference to FIG. 8 and FIG. 9, the stopper 52 is disposed on a front side (an upstream side in the insertion direction X) of the front frame 31 of the conveyance unit 5.

The stopper 52 is disposed adjacent to the lock member 51 on a left side (one side in the left-and-right direction) of the lock member 51.

The stopper 52 has a plate part 61 extending linearly along the left-and-right direction and a boss part 62 extending from the left end portion of the plate part 61 forward (in an upstream side in the insertion direction X).

In the right side portion and the center portion in the left-and-right direction of the plate part 61 of the stopper 52, long holes 64 are provided. Each long hole 64 is long in the left-and-right direction. Through the long holes 64, left and right screws 65 attached to the front frame 31 of the conveyance unit 5 are passed. That is, the plate part 61 is attached to the front frame 31 of the conveyance unit 5 with the left and right screws 65. Thus, the stopper 52 is movable linearly along the left-and-right direction between an allowable position (refer to FIG. 8) and an inhibition position (refer to FIG. 9). A stopper side attachment part 66 is protruded upwardly from the left side portion of the plate part 61.

Next, the coil spring 53 will be described.

With reference to FIG. 8 and FIG. 9, the coil spring 53 is disposed on a front side (an upstream side in the insertion direction X) of the front frame 31 of the conveyance unit 5. The coil spring 53 extends along the left-and-right direction. The right end portion of the coil spring 53 is attached to the frame side attachment part 38 of the front frame 31 of the conveyance unit 5, and the left end portion of the coil spring 53 is attached to the stopper side attachment part 66 of the plate part 61 of the stopper 52. In the above manner, the coil spring 53 is disposed between the front frame 31 of the conveyance unit 5 and the plate part 61 of the stopper 52. The coil spring 53 biases the stopper 52 to the inhibition position (refer to FIG. 9).

Next, operation to convey the sheet S from the first and second sheet feeding cassettes 3 and 4 to the sheet conveyance path 14 by the conveyance unit 5 (hereinafter, called "sheet conveyance operation") will be described.

In a case where the sheet S is conveyed from the first sheet feeding cassette 3 to the sheet conveyance path 14, the sheet S is fed by the pickup roller 40 of the first sheet feeding mechanism 33 from the first sheet feeding cassette 3. The sheet S fed from the first sheet feeding cassette 3 is conveyed in a direction inclined with respect to the horizontal direction by the feed roller 41, the retard roller 42 and the auxiliary conveyance rollers 43, and then sent to the sheet conveyance path 14.

On the other hand, in a case where the sheet S is conveyed from the second sheet feeding cassette 4 to the sheet conveyance path 14, the sheet S is fed by the pickup roller 40 of the second sheet feeding mechanism 34 from the second sheet feeding cassette 4. The sheet S fed from the second sheet feeding cassette 4 is conveyed in a direction inclined with respect to the horizontal direction by the feed roller 41, the retard roller 42 and the auxiliary conveyance rollers 43, and then sent to the horizontal conveyance path 47 of the horizontal conveyance mechanism 35. The sheet S sent to the horizontal conveyance path 47 of the horizontal conveyance mechanism 35 is conveyed along the horizontal direction by the lower conveyance rollers 48 and the upper conveyance rollers 49 of the horizontal conveyance mechanism 35, and then sent to the sheet conveyance path 14.

Next, operation to remove the sheet S jammed in the horizontal conveyance path 47 of the horizontal conveyance mechanism 35 (hereinafter, called "jam treatment operation") will be described.

Firstly, an operator draws the first and second sheet feeding cassettes 3 and 4 out of the apparatus main body 2. Then, the operator operates the lever part 56 of the lock member 51 to rotate the lock member 51 from the lock position (refer to FIG. 8 and FIG. 10) to the lock release position (refer to FIG. 9 and FIG. 11). Thus, the engagement of the engagement part 58 of the lock member 51 with a side plate 2*a* of the apparatus main body 2 (refer to FIG. 10 and FIG. 11) is released so that the conveyance unit 5 is allowed to be drawn out of the apparatus main body 2. When the lock member 51 is rotated from the lock position (refer to FIG. 8 and FIG. 10) to the lock release position (refer to FIG. 9 and FIG. 11), the stopper 52 is moved linearly from the allowable position (refer to FIG. 8) to the inhibition position (refer to FIG. 9) by the biasing force of the coil spring 53.

Next, the operator draws the conveyance unit 5 out of the apparatus main body 2, and then turns the upper conveyance guide 46 of the horizontal conveyance mechanism 35 from the close position (refer to the solid line in FIG. 7) to the open position (refer to the two-dotted chain line in FIG. 7). Thereby, the horizontal conveyance path 47 of the horizontal conveyance mechanism 35 is opened. Next, the operator removes the sheet S jammed in the horizontal conveyance path 47 of the horizontal conveyance mechanism 35.

Next, the operator turns the upper conveyance guide 46 from the open position (refer to the two-dotted chain line in FIG. 7) to the close position (refer to the solid line in FIG. 7), and then inserts the conveyance unit 5 into the apparatus main body 2. Next, the operator operates the lever part 56 of the lock member 51 to turn the lock member 51 from the lock release position (refer to FIG. 9 and FIG. 11) to the lock position (refer to FIG. 8 and FIG. 10). Thus, the engagement part 58 of the lock member 51 is engaged with the side plate 2*a* of the apparatus main body 2 (refer to FIG. 10 and FIG. 11) so that the conveyance unit 5 is inhibited from being drawn out of the apparatus main body 2. When the lock member 51 is rotated from the lock release position (refer to FIG. 9 and FIG. 11) to the lock position (refer to FIG. 8 and FIG. 10), the tip end portion 57*a* of the pushing part 57 of the lock member 51 pushes the right end portion of the plate part 61 of the stopper 52 leftward. Then, the stopper 52 is moved linearly from the inhibition position (refer to FIG. 9) to the allowable position (refer to FIG. 8) against the biasing force of the coil spring 53.

Finally, the operator inserts the first and second sheet feeding cassettes 3 and 4 into the apparatus main body 2. Then, the jam treatment operation is completed.

By the way, in the above described image forming apparatus 1, when the sheet conveyance operation is performed in a state where the lock member 51 is in the lock release position (refer to FIG. 9 and FIG. 11), there is a possibility that the conveyance unit 5 is displaced with respect to the apparatus main body 2. If the conveyance unit 5 may be displaced with respect to the apparatus main body 2, the conveyance position of the sheet S by the conveyance unit 5 may be also displaced, causing the sheet jamming and the sheet skew. Then, the present embodiment inhibits the sheet feeding operation from being performed in the state where the lock member 51 is in the lock release position (refer to FIG. 9 and FIG. 11) by the following manner.

Figure 12:
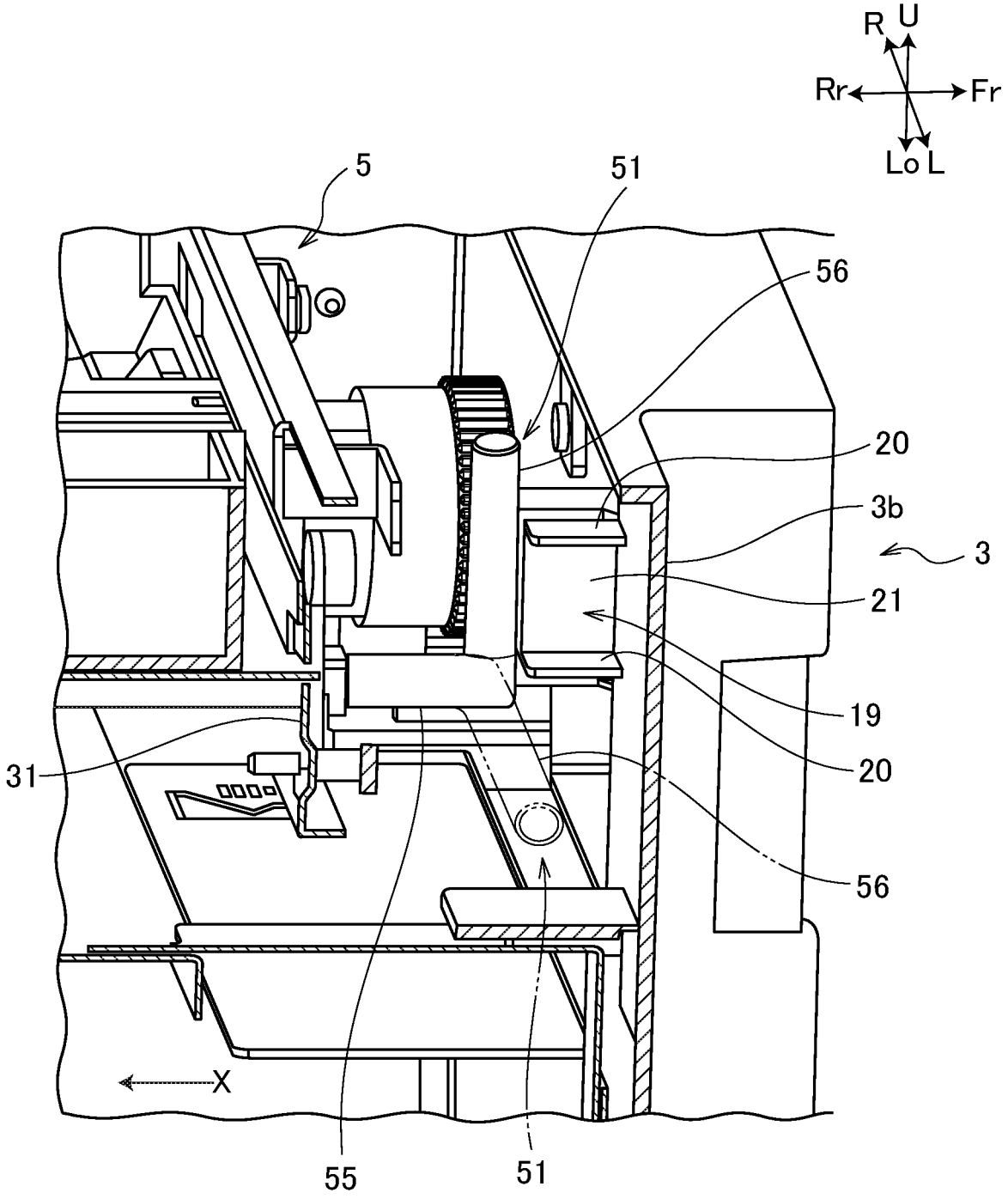
FIG. 12 is a perspective view showing a first rib of the first sheet feeding cassette interfered with a lever part of the lock member, in the image forming apparatus according to the embodiment of the present disclosure.

As shown by the two-dotted chain line in FIG. 12, in the state where the lock member 51 is in the lock position, the first rib 19 of the first sheet feeding cassette 3 does not interfere with the lever part 56 of the lock member 51 so that the first sheet feeding cassette 3 is allowed to be inserted into the apparatus main body 2. Thereby, it becomes possible to insert the first sheet feeding cassette 3 into the apparatus main body 2 and to perform the sheet conveyance operation.

On the other hand, as shown by the solid line in FIG. 12, in the state where the lock member 51 is in the lock release position, the first rib 19 of the first sheet feeding cassette 3 interferes with the lever part 56 of the lock member 51 so that the first sheet feeding cassette 3 is inhibited from being inserted into the apparatus main body 2. Thereby, it becomes impossible to insert the first sheet feeding cassette 3 into the apparatus main body 2 and to perform the sheet conveyance operation.

As described above, in the present embodiment, in the state where the lock member 51 is in the lock release position, the first sheet feeding cassette 3 is inhibited from being inserted into the apparatus main body 2 so that the sheet conveyance operation is inhibited from being performed. Therefore, it becomes possible to prevent the displacement of the conveyance unit 5 with respect to the apparatus main body 2 and to inhibit the sheet jamming and the sheet screw caused by the above displacement of the conveyance unit 5.

Additionally, by applying the above configuration, in the state where the lock member 51 is in the lock release position, it becomes possible to inhibit the sheet conveyance operation from being performed without using an electric component that is easily broken (such as a sensor and a switch). Therefore, it becomes possible to reduce a cost and work required for replacement of the component.

Figure 13:
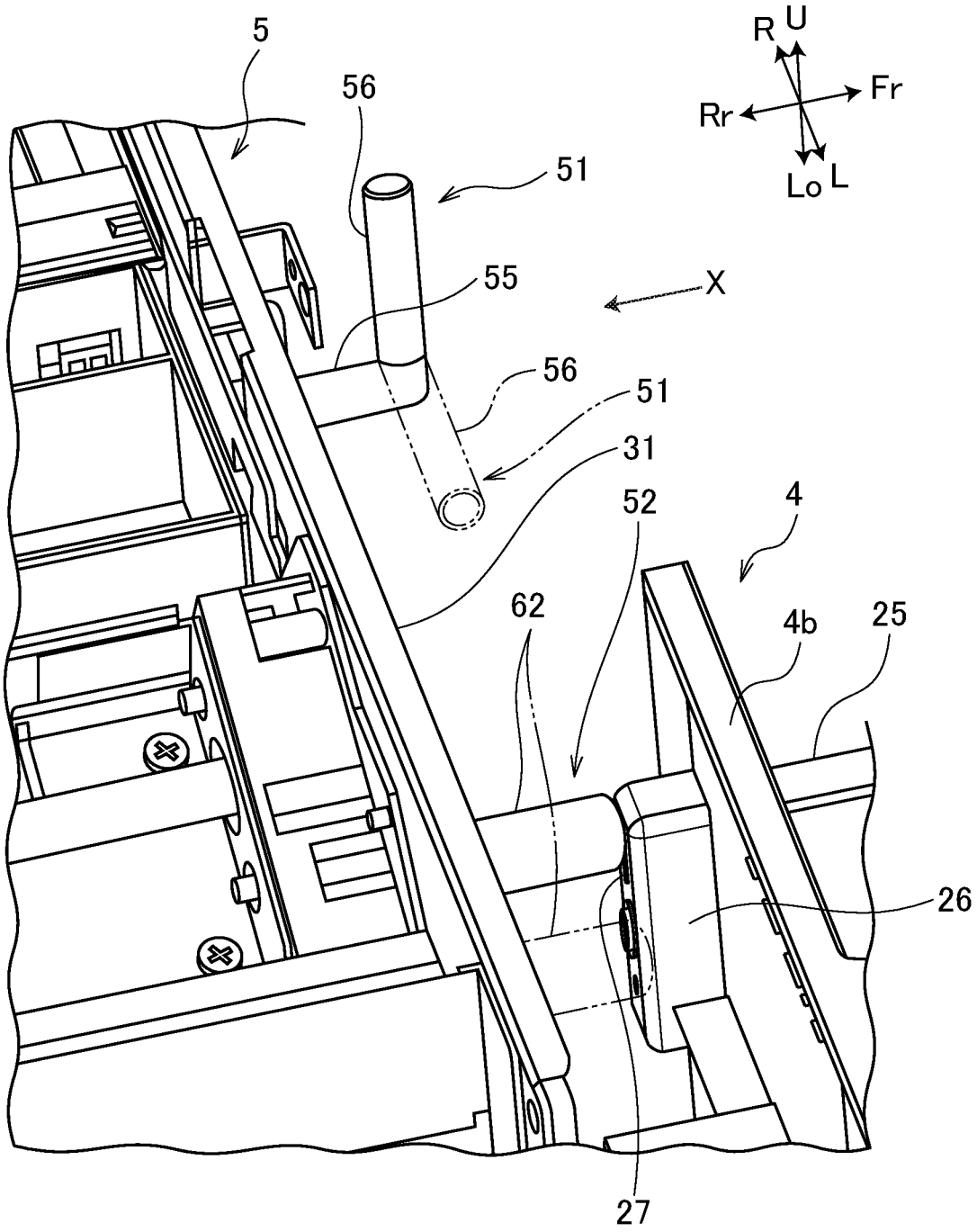
FIG. 13 is a perspective view showing a second rib of the second sheet feeding cassette interfered with a boss part of the stopper, in the image forming apparatus according to the embodiment of the present disclosure.

Additionally, as shown by the two-dotted chain line in FIG. 13, because the stopper 52 is in the allowable position in the state where the lock member 51 is in the lock position, the second rib 27 of the second sheet feeding cassette 4 does not interfere with the boss part 62 of the stopper 52 so that the insertion of the second sheet feeding cassette 4 into the apparatus main body 2 is allowed. Therefore, it becomes possible to insert the second sheet feeding cassette 4 into the apparatus main body 2 and to perform the sheet conveyance operation.

On the other hand, as shown in the solid line in FIG. 13, because the stopper 52 is in the inhibition position in the state where the lock member 51 is in the lock release position, the second rib 27 of the second sheet feeding cassette 4 interferes with the boss part 62 of the stopper 52 so that the insertion of the second sheet feeding cassette 4 into the apparatus main body 2 is inhibited. Therefore, it becomes impossible to insert the second sheet feeding cassette 4 into the apparatus main body 2 and to perform the sheet conveyance operation.

As described above, in the present embodiment, in the state where the lock member 51 is in the lock release position, the second sheet feeding cassette 4 is inhibited from being inserted into the apparatus main body 2, and the sheet conveyance operation is not allowed to be performed. Therefore, it becomes possible to prevent the displacement of the conveyance unit 5 with respect to the apparatus main body 2 more surely and to inhibit the sheet jamming and the sheet skew caused by the above displacement more surely.

Additionally, when the lock member 51 is rotated from the lock release position to the lock position, the lock member 51 pushes the stopper 52 to move the stopper 52 linearly from the inhibition position to the allowable position. By applying such a configuration, it becomes possible to move the stopper 52 from the inhibition position to the allowable position surely by using a simple structure.

Additionally, when the lock member 51 is rotated from the lock position to the lock release position, the stopper 52 is moved linearly from the allowable position to the inhibition position by the biasing force of the coil spring 53. By applying such a configuration, it becomes possible to move the stopper 52 from the allowable position to the inhibition position surely as the lock member 51 is rotated from the lock position to the lock release position. Therefore, it becomes possible to inhibit the sheet conveyance operation from being performed more surely in the state where the lock member 51 is in the lock release position.

Additionally, the lock member 51 and the stopper 52 are provided in the conveyance unit 5. By applying such a configuration, it becomes possible to draw the lock member 51 and the stopper 52 together with the conveyance unit 5 out of the apparatus main body 2 so that it becomes possible to improve a maintenance performance of the lock member 51 and the stopper 52.

Additionally, in the state where the lock member 51 is in the lock position, the engagement part 58 of the lock member 51 is engaged with the side plate 2*a* of the apparatus main body 2 so that the conveyance unit 5 is inhibited from being drawn out of the apparatus main body 2. By applying such a configuration, it becomes possible to inhibit the conveyance unit 5 from being drawn out of the apparatus main body 2 surely using a simple structure.

Additionally, in the state where the lock member 51 is in the lock release position, the first rib 19 of the first sheet feeding cassette 3 interferes with the lever part 56 of the lock member 51 so that the first sheet feeding cassette 3 is inhibited from being inserted into the apparatus main body 2. By applying such a configuration, the lever part 56 that is operated by the operator can be used together with the portion which interferes with the first sheet feeding cassette 3. Therefore, it becomes possible to inhibit the complication in structure of the lock member 51.

The conveyance unit 5 includes the horizontal conveyance mechanism 35 which conveys the sheet S in the horizontal direction. By applying such a configuration, it becomes possible to realize the sheet feeding from the first and the second sheet feeding cassette 3 and 4, which are disposed side by side in the left-and-right direction, using the single conveyance unit 5.

In the present embodiment, the lock member 51 is rotatable between the lock position and the lock release position. On the other hand, in the other embodiments, the lock member 51 may be movable linearly between the lock position and the lock release position.

In the present embodiment, the stopper 52 is rotatable between the allowable position and the inhibition position. On the other hand, in the other embodiments, the stopper 52 may be movable linearly between the allowable position and the inhibition position.

In the present embodiment, the lock member 51 and the stopper 52 are provided in the conveyance unit 5. On the other hand, in the other embodiments, the lock member 51 and the stopper 52 may be provided in the apparatus main body 2, or the first and the second sheet feeding cassette 3 and 4.

In the present embodiment, the conveyance unit includes the first and the second sheet feeding mechanism 33 and 34 and the horizontal conveyance mechanism 35. On the other hand, in the other embodiments, the conveyance unit 5 may include one or a plurality of sheet feeding mechanisms.

In the present embodiment, the image forming apparatus 1 includes a plurality of the sheet feeding cassettes 3, 4, 6 and 7. On the other hand, in the other embodiments, the image forming apparatus 1 may include one sheet feeding cassette.

In the present embodiment, the image forming apparatus 1 is a color printer. On the other hand, in other embodiments, the image forming apparatus 1 may be a monochrome printer, a copying machine, a facsimile and a multifunctional peripheral (an apparatus having a printing function, a copying function and a facsimile function totally).

In the present embodiment, the image forming apparatus 1 applies an inkjet type image forming method. On the other hand, in other embodiments, the image forming apparatus 1 may apply an electrophotographic type image forming method.

The invention claimed is:

1. An image forming apparatus comprising:

an apparatus main body in which a sheet conveyance path is formed;

a first sheet feeding cassette which is inserted into the apparatus main body along a predetermined insertion direction and is drawn out of the apparatus main body along a drawing direction opposite to the insertion direction, the first sheet feeding cassette storing a sheet;

a conveyance unit which is drawn out of the apparatus main body along the drawing direction after the first sheet feeding cassette is drawn out, and is inserted into the apparatus main body along the insertion direction before the first sheet feeding cassette is inserted, the conveyance unit feeding the sheet and then conveying the sheet to the sheet conveyance path;

a second sheet feeding cassette which is drawn out of the apparatus main body along the drawing direction before the conveyance unit is drawn out, and is inserted into the apparatus main body after the conveyance unit is inserted, the second sheet feeding cassette disposed adjacent to the first sheet feeding cassette in a direction perpendicular to the insertion direction and storing the sheet;

a lock member displaced between a lock position where the lock member inhibits the conveyance unit from being drawn out of the apparatus main body and a lock release position where the lock member allows the conveyance unit to be drawn out of the apparatus main body; and a stopper displaced between an allowable position where the stopper does not interfere with the second sheet feeding cassette to allow the second sheet feeding cassette to be inserted into the apparatus main body and an inhibition position where the stopper interferes with the second sheet feeding cassette to inhibit the second sheet feeding cassette from being inserted into the apparatus main body, wherein in a state where the lock member is in the lock position, the first sheet feeding cassette does not interfere with the lock member to allow the first sheet feeding cassette to be inserted into the apparatus main body, in a state where the lock member is in the lock release position, the first sheet feeding cassette interferes with the lock member to inhibit the first sheet feeding cassette from being inserted into the apparatus main body, and the lock member is displaced from the lock release position to the lock position to displace the stopper from the inhibition position to the allowable position, and the lock member is displaced from the lock position to the lock release position to displace the stopper from the allowable position to the inhibition position.

2. The image forming apparatus according to claim 1, wherein the lock member is rotated between the lock position and the lock release position, the stopper is moved linearly along a direction perpendicular to the insertion direction between the allowable position and the inhibition position, and when the lock member is rotated from the lock release position to the lock position, the lock member pushes the stopper to move the stopper linearly from the inhibition position to the allowable position.

3. The image forming apparatus according to claim 2, wherein the first sheet feeding cassette is disposed adjacent to the second sheet feeding cassette in a horizontal direction perpendicular to the insertion direction, and the stopper is movable linearly along the horizontal direction perpendicular to the insertion direction.

4. The image forming apparatus according to claim 2, further comprising a biasing member biasing the stopper to the inhibition position, wherein when the lock member is rotated from the lock position to the lock release position, the stopper is moved linearly from the allowable position to the inhibition position by a biasing force of the biasing member.

5. The image forming apparatus according to claim 1, wherein the lock member and the stopper are provided in the conveyance unit.

6. The image forming apparatus according to claim 1, wherein the conveyance unit includes:

a horizontal conveyance path along which the sheet is conveyed in a conveyance direction along a horizontal direction, a first sheet feeding mechanism disposed at an end portion of the horizontal conveyance path on a downstream side in the conveyance direction and feeding the sheet from the first sheet feeding cassette to the sheet conveyance path, and a second sheet feeding mechanism disposed at an end portion of the horizontal conveyance path on an upstream side in the conveyance direction and feeding the sheet from the second sheet feeding cassette to the horizontal conveyance path.

7. The image forming apparatus according to claim 1, wherein the lock member includes:

a shaft part extending along the insertion direction;

a lever part extending in a radial direction of the shaft part from an end portion of the shaft part on an upstream side in the insertion direction; and an engagement part extending in the radial direction of the shaft part from an end portion of the shaft part on a downstream side in the insertion direction, in the state where the lock member is in the lock position, the engagement part is engaged with a side plate of the apparatus main body to inhibit the conveyance unit from being drawn out of the apparatus main body, and in the state where the lock member is in the lock release position, an engagement of the engagement part with the side plate is released to allow the conveyance unit to be drawn out of the apparatus main body.

8. The image forming apparatus according to claim 7, wherein the first sheet feeding cassette has a rib protruding to a downstream side in the insertion direction, and in the state where the lock member is in the lock release position, the rib interferes with the lever part to inhibit the first sheet feeding cassette from being inserted into the apparatus main body.

9. The image forming apparatus according to claim 1, wherein the stopper has a boss part protruding to an upstream side in the insertion direction, the second sheet feeding cassette has a rib protruding to the downstream side in the insertion direction, and in the state where the stopper is in the inhibition position, the boss part interferes with the rib to inhibit the second sheet feeding cassette from being inserted into the apparatus main body.

* * * * *